US010545433B2

(12) United States Patent
Itani et al.

(10) Patent No.: US 10,545,433 B2
(45) Date of Patent: Jan. 28, 2020

(54) IMAGE FORMING APPARATUS

(71) Applicant: KYOCERA Document Solutions Inc., Osaka (JP)

(72) Inventors: Hiroka Itani, Osaka (JP); Keigo Kimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/393,584

(22) Filed: Apr. 24, 2019

(65) Prior Publication Data

US 2019/0377282 A1 Dec. 12, 2019

(30) Foreign Application Priority Data

Jun. 6, 2018 (JP) ..... 2018-108293

(51) Int. Cl.

| | |
|---|---|
| ***G03G 15/20*** | (2006.01) |
| ***G03G 15/16*** | (2006.01) |
| ***G03G 15/00*** | (2006.01) |
| ***G03G 21/00*** | (2006.01) |

(52) U.S. Cl.

CPC ..... *G03G 15/161* (2013.01); *G03G 15/162* (2013.01); *G03G 15/5004* (2013.01); *G03G 15/5008* (2013.01); *G03G 21/0011* (2013.01); *G03G 2215/1623* (2013.01)

(58) Field of Classification Search

CPC ..... G03G 145/0189; G03G 15/0194; G03G 15/161; G03G 15/162; G03G 15/5004; G03G 15/5008; G03G 21/0011

USPC ..... 399/66, 130, 297–299, 302, 306, 308

See application file for complete search history.

(56) References Cited

U.S. PATENT DOCUMENTS

| | | | | |
|---|---|---|---|---|
| 8,639,161 | B2 * | 1/2014 | Nishizawa | G03G 15/161 399/121 |
| 9,651,899 | B2 * | 5/2017 | Makinodan | G03G 15/161 |
| 2012/0064350 | A1 * | 3/2012 | Honya | G03G 15/0131 428/411.1 |

FOREIGN PATENT DOCUMENTS

| | | | |
|---|---|---|---|
| JP | 2008-129448 | A | 6/2008 |

* cited by examiner

*Primary Examiner* — Hoan H Tran
(74) *Attorney, Agent, or Firm* — Stein IP, LLC

(57) ABSTRACT

An image forming apparatus has a plurality of image forming portions, an intermediate transfer belt having an elastic layer, a plurality of primary transfer members, a contact-separation mechanism, a secondary transfer member, a driving device, a voltage applying device, and a control portion. The contact-separation mechanism is switchable between an all-color pressure state where the primary transfer members are all in pressed contact with the image carrying members via the intermediate transfer belt and an all-color apart state where the primary transfer members are all away from the intermediate transfer belt. At first power-on, the control portion starts driving the image carrying members and the intermediate transfer belt in the all-color apart state, then transits to the all-color pressure state, and then ejects toner from the developing device to the image carrying members to reduce the surface friction coefficient on the image carrying members and the intermediate transfer belt.

11 Claims, 6 Drawing Sheets

IMAGE FORMING APPARATUS

INCORPORATION BY REFERENCE

This application is based upon and claims the benefit of priority from the corresponding Japanese Patent Application No. 2018-108293 filed on Jun. 6, 2018, the entire contents of which are incorporated herein by reference.

BACKGROUND

The present disclosure relates to an image forming apparatus utilizing electrophotography such as copiers, printers, and facsimile machines. More particularly, the present disclosure relates to an image forming apparatus of an intermediate transfer type that primarily transfers a toner image formed on an image carrying member to an intermediate transfer belt and that then secondarily transfers the toner image from the intermediate transfer belt to a recording medium.

Conventionally, there is known an image forming apparatus of an intermediate transfer type that includes an endless intermediate transfer belt rotated in a predetermined direction and a plurality of image forming portions provided along the intermediate transfer belt. This image forming apparatus primarily transfers, by sequentially superimposing on one another, toner images of different colors onto the intermediate transfer belt from photosensitive drums (image carrying members) provided in the image forming portions, and then secondarily transfers them to a recording medium.

In a color image forming apparatus of the intermediate transfer type, when an intermediate transfer belt of an elastic material is used, as the number of printed sheets increases, a toner external additive adheres to the surface of the belt and thereby causes it to whiten. The surface friction coefficient on the belt, unwhitened, is high but lowers with the progress of whitening.

The progress of whitening of the surface of the belt causes, during density calibration, variation in the output value of an image density sensor (ID sensor) that senses the density of a reference image formed on the surface of the belt, and leads to lower calibration accuracy. To avoid that, conventionally, the assembly of the image forming apparatus includes an application process in which a toner external additive is previously applied to the surface of the intermediate transfer belt. However, in recent years, improved image density sensors and calibration methods have alleviated the effect of the whitening of the surface of the belt, and thus the application process tends to be omitted to reduce manufacturing steps and cost.

On the other hand, when organic photosensitive members (OPC), which are laid with organic photosensitive layers on their surfaces, are used as photosensitive drums, photosensitive layers are electrostatically charged during the process of preparatory charging or potential adjustment for the photosensitive drums. Owing to this charging, the surface friction coefficient on the unused photosensitive drums before printing is high. That is, when the image forming apparatus is turned on (starts to be used) for the first time, the intermediate transfer belt and the photosensitive drums, both with a high surface friction coefficient, are combined. Here, when driving is started in a state where the intermediate transfer belt is pressed against the photosensitive drums, a high drum-belt friction force is produced. A drum-belt friction torque propagates to the blade edge of cleaning blades that remove toner on the surface of the photosensitive drums, and thus, though not so high as between belt and drum, a friction force is produced also between blade and drum. The charging performance of the organic photosensitive members lowers as a result of the surfaces being rubbed, and this causes a lower potential; thus, lateral streaks appear in a half image at the primary transfer positions and at the blade edge positions.

As a method for reducing the friction between the intermediate transfer belt and the photosensitive drums, an image forming apparatus is known which has an all apart drivable mode in which, when the intermediate transfer belt and the image carrying members are started up to a speed during image formation, and when the intermediate transfer belt is rotated in the direction opposite to its rotation direction during image formation, with the intermediate transfer belt given such a tension as to be drivable, the image carrying members are all kept away from the intermediate transfer belt.

SUMMARY

According to one aspect of the present disclosure, an image forming apparatus includes a plurality of image forming portions, an intermediate transfer belt, a plurality of primary transfer members, a contact-separation mechanism, a secondary transfer member, a driving device, a voltage applying device, and a control portion. The image forming portions include image carrying members and developing devices feeding toner to the image carrying members, and form images of different colors. The intermediate transfer belt is an endless belt, moves along the image forming portions, and has an elastic layer. The primary transfer members are arranged opposite the image carrying members across the intermediate transfer belt, and primarily transfer toner images formed on the image carrying members to the intermediate transfer belt. The contact-separation mechanism moves the primary transfer members in the direction approaching the intermediate transfer belt to put the intermediate transfer belt into pressed contact with the image carrying members, and moves the primary transfer members in the direction away from the intermediate transfer belt to move the intermediate transfer belt away from the image carrying members. The secondary transfer member makes contact with the intermediate transfer belt to secondarily transfer the toner images primarily transferred on the intermediate transfer belt to a recording medium. The driving device drives the image carrying members and the intermediate transfer belt to rotate individually. The voltage applying device applies a voltage to the primary transfer members and the secondary transfer member. The control portion controls the image forming portions, the contact-separation mechanism, the voltage applying device, and the driving device. The contact-separation mechanism is switchable between an all-color pressure state where the primary transfer members are all in pressed contact with the image carrying members via the intermediate transfer belt and an all-color apart state where the primary transfer members are all away from the intermediate transfer belt. The control portion can execute, at first power-on, a reduced friction coefficient mode in which the control portion starts to drive the image carrying members and the intermediate transfer belt in the all-color apart state, then transits to the all-color pressure state, and then ejects toner from the developing device to the image carrying members to reduce the surface friction coefficient on the image carrying members and the intermediate transfer belt.

Further features and advantages of the present disclosure will become apparent from the description of embodiments given below.

DETAILED DESCRIPTION

Figure 1:
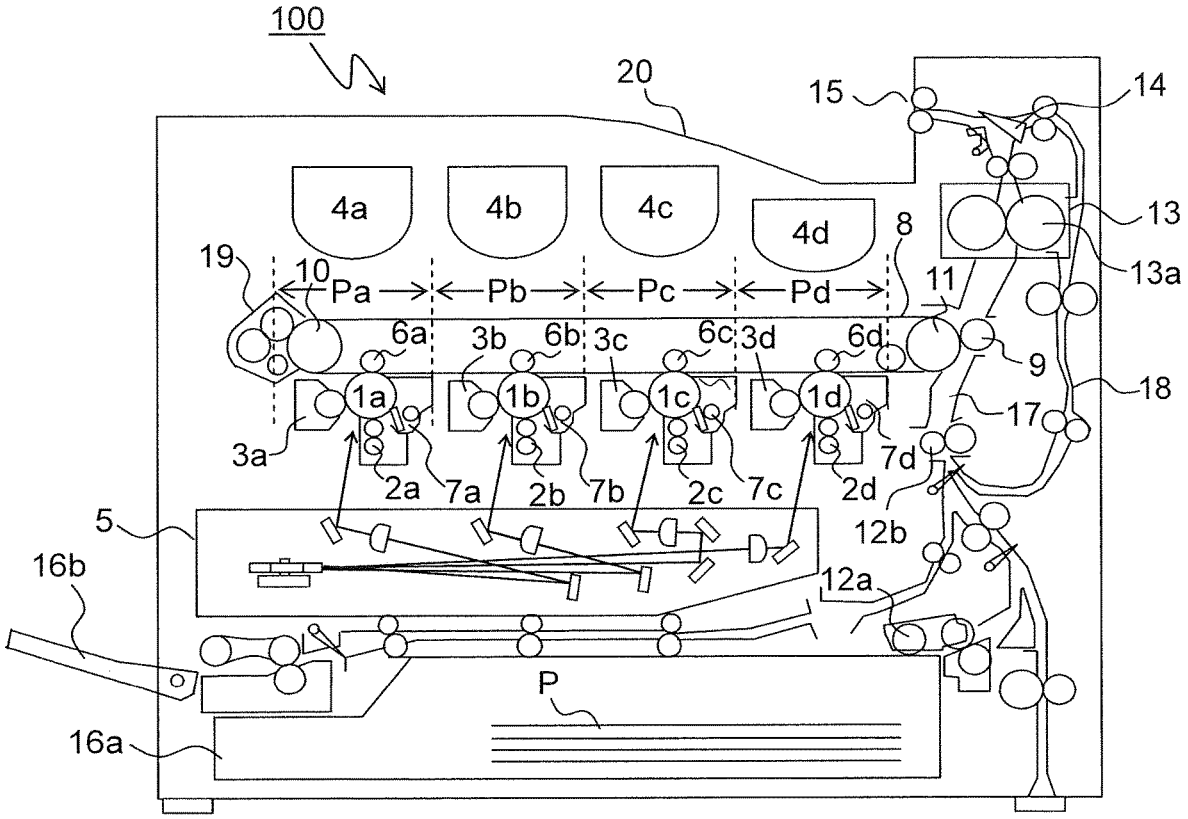
FIG. 1 is a sectional view showing an outline of a construction of a color printer according to one embodiment of the present disclosure.

Hereinafter, with reference to the accompanying drawings, an embodiment of the present disclosure will be described. FIG. 1 is a schematic sectional view of an image forming apparatus according to one embodiment of the present disclosure, here showing a tandem-type color printer. In a main body of a color printer 100, four image forming portions Pa, Pb, Pc, and Pd are arranged in this order from the upstream side in the conveying direction (in FIG. 1, the left side). These image forming portions Pa to Pd are provided to correspond to images of four different colors (cyan, magenta, yellow, and black) respectively, and sequentially form cyan, magenta, yellow, and black images respectively through the processes of charging, exposure, developing, and transferring.

In these image forming portions Pa to Pd, there are respectively arranged photosensitive drums 1*a*, 1*b*, 1*c*, and 1*d* that carry visible images (toner images) of the different colors. The photosensitive drums 1*a* to 1*d* are, for example, organic photosensitive members that are drum pipes made of aluminum laid with organic photosensitive layers (OPC) on their circumferential faces, and are driven to rotate by a main motor 40 (see FIG. 4). An intermediate transfer belt 8 that rotates in the counter-clockwise direction in FIG. 1 is arranged next to the image forming portions Pa to Pd. The intermediate transfer belt 8 is driven to rotate by a belt driving motor 41 (see FIGS. 2 and 4). A secondary transfer roller 9 is arranged next to the intermediate transfer belt 8.

When image data is fed in from a host device such as a personal computer, first, the surfaces of the photosensitive drums 1*a* to 1*d* are electrostatically charged uniformly by charging devices 2*a* to 2*d*. Then, the surfaces of the photosensitive drums 1*a* to 1*d* are irradiated with light based on the image data by an exposure unit 5, and thereby electrostatic latent images based on the image data are formed on the photosensitive drums 1*a* to 1*d*, respectively. Developing devices 3*a* to 3*d* are charged with predetermined amounts of two-component developer (hereinafter, also referred to simply as developer) containing toner of different colors, namely cyan, magenta, yellow, and black, respectively, from toner containers 4*a* to 4*d*. The toner contained in the developer is fed from the developing devices 3*a* to 3*d* to the photosensitive drums 1*a* to 1*d*, and electrostatically attaches to them. Thereby, toner images are formed based on the electrostatic latent images formed by exposure to light from the exposure unit 5.

The charging devices 2*a* to 2*d* include charging rollers 21 (see FIG. 2) that electrically charge the surfaces of the photosensitive drums 1*a* to 1*d* while in contact with them. In this embodiment, to reduce the amount of generated ozone and to reduce the cost of a charging voltage power supply 52 (see FIG. 4), a charging voltage comprising a DC voltage alone is applied to the charging rollers 21.

The developing devices 3*a* to 3*d* include developing rollers 30 (see FIG. 2) opposite the photosensitive drums 1*a* to 1*d*. In the developing devices 3*a* to 3*d*, two-component developer containing carrier and toner is stored, and the two-component developer is fed to the developing rollers 30 by stirring/transporting members (unillustrated); thereby, magnetic brushes are formed on the developing rollers 30. To the developing rollers 30, a developing voltage having an AC voltage superimposed on a DC voltage is applied from a developing voltage power supply 53 (see FIG. 4).

Figure 2:
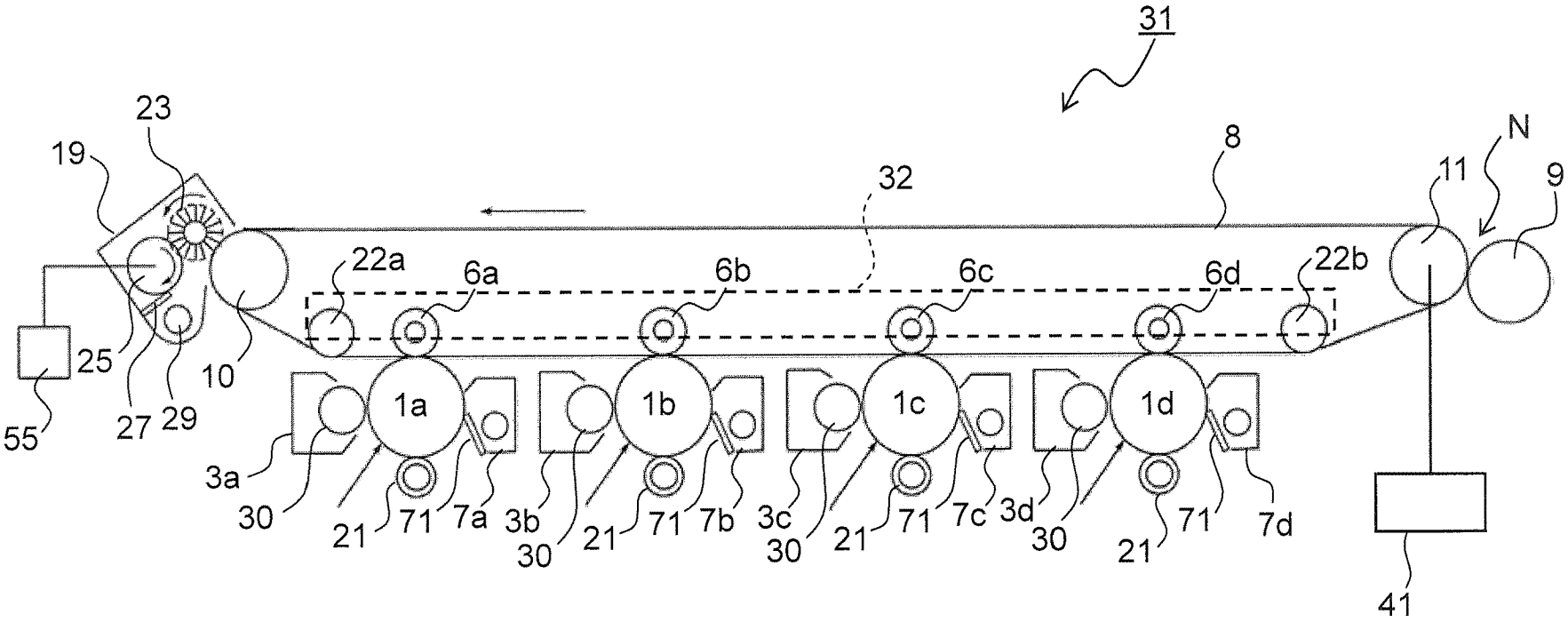
FIG. 2 is a side sectional view showing a structure of and around an intermediate transfer unit incorporated in the color printer.

As the developing rollers 30 to which the developing voltage is applied rotate in the counter-clockwise direction in FIG. 2, due to a potential difference between the developing potential and the potential at the exposed parts of the photosensitive drums 1*a* to 1*d*, toner is fed from the magnetic brushes carried on the surfaces of the developing rollers 30 to the photosensitive drums 1*a* to 1*d*. The toner sequentially attaches to the exported parts of the photosensitive drums 1*a* to 1*d* rotating in the clockwise direction, and thereby the electrostatic latent images on the photosensitive drums 1*a* to 1*d* are developed into toner images.

Then, an electric field with a predetermined transfer voltage is applied, by primary transfer rollers 6*a* to 6*d*, between the primary transfer rollers 6*a* to 6*d* and the photosensitive drums 1*a* to 1*d*, and thereby the cyan, magenta, yellow, and black toner images on the photosensitive drums 1*a* to 1*d* are primarily transferred to the intermediate transfer belt 8. Toner and the like that remain on the surfaces of the photosensitive drums 1*a* to 1*d* after primary transfer are removed by cleaning devices 7*a* to 7*d*.

The cleaning devices 7*a* to 7*d* include cleaning blades 71 (see FIG. 2) that remove toner remaining on the surfaces of the photosensitive drums 1*a* to 1*d*. As the cleaning blade 71, for example, a blade made of polyurethane rubber is used.

Transfer sheets P to which toner images are to be transferred are stored in a sheet feed cassette 16*a* arranged in a lower part inside the color printer 100 or are placed on a manual feed tray 16*b* arranged at a side face of the color printer 100. A transfer sheet P in the sheet feed cassette 16*a* or on the manual feed tray 16*b* is conveyed through a sheet conveying passage 17 via a feeding roller 12*a* and a registration roller pair 12*b* to, with a predetermined timing, a nip portion (secondary transfer nip portion N, see FIG. 2) between the secondary transfer roller 9 and the intermediate transfer belt 8. The transfer sheet P having the toner images secondary transferred to it is conveyed to a fixing portion 13. Toner and the like that remain on the surface of the intermediate transfer belt 8 are removed by a belt cleaning unit 19.

The transfer sheet P conveyed to the fixing portion 13 is then heated and pressed by a fixing roller pair 13*a*, so that the toner images are fixed to the surface of the transfer sheet P, and thereby a predetermined full-color image is formed. The transfer sheet P having the full-color image formed on it is discharged as it is (or after being distributed by a brunch portion 14 into a reverse conveying passage 18 and having images formed on both sides of it) onto a discharge tray 20 from the sheet conveying passage 17 via a discharge roller pair 15.

Figure 3:
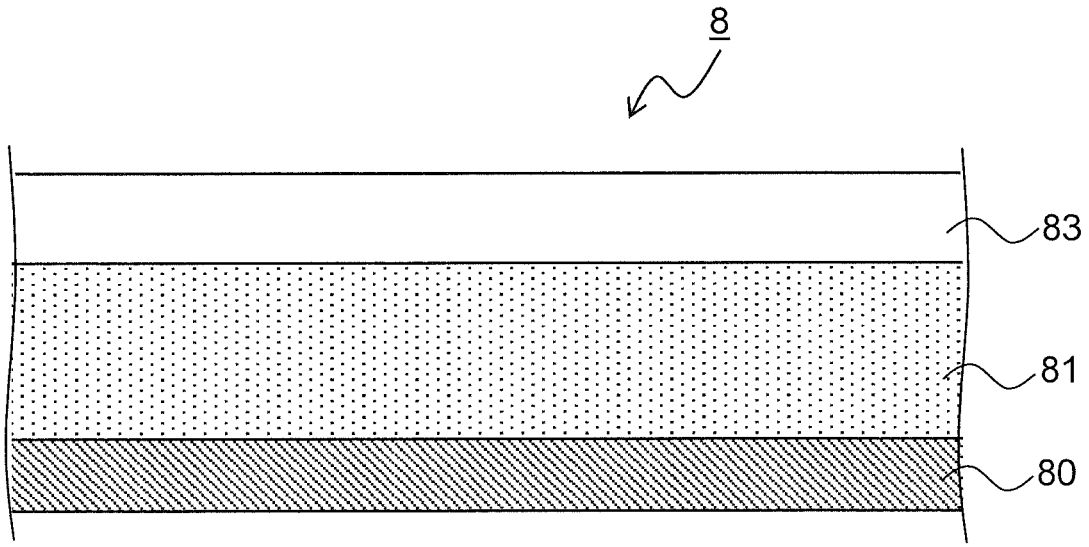
FIG. 3 is a partial sectional view showing a layered structure of an intermediate transfer belt.

FIG. 2 is a side sectional view showing a structure of and around an intermediate transfer unit 31 incorporated in the color printer 100 according to this embodiment. FIG. 3 is a partial sectional view showing a layered structure of the intermediate transfer belt 8. As shown in FIG. 2, the intermediate transfer unit 31 includes the intermediate transfer belt 8 that is wound around a tension roller 10 on the upstream side and a driving roller 11 on the downstream side, the primary transfer rollers 6*a* to 6*d* that make contact with the photosensitive drums 1*a* to 1*d* via the intermediate transfer belt 8, back-up rollers 22*a* and 22*b*, the belt cleaning unit 19, and a roller contact-separation mechanism 32. The driving roller 11 is coupled with a belt driving motor 41 via a gear train (unillustrated).

The intermediate transfer belt 8 is, as shown in FIG. 3, an electrically conductive belt of a three-layer structure comprising, for example, a base material layer 80, an elastic layer 81, and a coat layer 83, and the coat layer 83 makes contact with the photosensitive drums 1*a* to 1*d*. It is preferable that the base material layer 80 be a base material that forms the intermediate transfer belt 8 and provide a predetermined rigidity, that the base material layer 80 withstand the processing conditions under which the elastic layer 81 and the coat layer 83 are laid on it, and that the base material layer 80 be, when the intermediate transfer belt 8 is manufactured, excellent in processing workability, heat resistance, slipperiness, and other physical properties. As the material of such a base material layer 80, for example, PVDF (polyvinylidene fluoride), polyimide resin, and the like can be suitably used.

The elastic layer 81 gives elasticity to the intermediate transfer belt 8, and thereby prevents dropouts in an image resulting from concentration of stress. As the material of the elastic layer 81, for example, hydrin rubber, chloroprene rubber, polyurethane rubber, and the like can be used. The coat layer 83 serves to protect the elastic layer 81, and as the material of the coat layer 83, acrylic resin, silicon, fluorine resin, and the like can be used.

It is also possible to use a structure that does not include the base material layer 80 or that includes any other layer than the base material layer 80, the elastic layer 81, and the coat layer 83. No limitation to a layered structure is meant; instead, a single layer structure having only the elastic layer 81 may be used.

The belt cleaning unit 19 includes, in a housing, a fur brush 23, a collection roller 25, a scraper 27, and a conveying spiral 29. The fur brush 23 is arranged opposite the tension roller 10 via the intermediate transfer belt 8. The fur brush 23 rotates in the counter direction (in FIG. 2, the counter-clockwise direction) with respect to the moving direction of the intermediate transfer belt 8, and thereby scrapes off foreign matter, such as toner and paper particles (hereinafter, referred to as toner and the like) that remain on the intermediate transfer belt 8. A brush part of the fur brush 23 that makes contact with the collection roller 25 is formed of electrically conductive fiber having an electrical resistance value of about 1 to 900 MΩ.

The collection roller 25 rotates in the counter direction (in FIG. 2, the clockwise direction) with respect to the fur brush 23 while in contact with the surface of the fur brush 23, and thereby collects toner and the like attached to the fur brush 23. To the collection roller 25, a belt cleaning voltage power supply 55 (see FIG. 4) is connected, and when the intermediate transfer belt 8 is cleaned, a cleaning voltage of the opposite polarity (here, negative polarity) to toner is applied. The tension roller 10 is grounded (earthed). As a result, the toner and the like scraped off the intermediate transfer belt 8 are collected electrically and mechanically by the brush part of the fur brush 23, and then move electrically to the collection roller 25. The conveying spiral 29 conveys the toner and the like scraped off the collection roller 25 by the scraper 27 to a waste toner container (unillustrated) outside the housing.

The roller contact-separation mechanism 32 is switchable among a four-color pressure state (all-color pressure state) where the four primary transfer rollers 6*a* to 6*d* are all in pressed contact with the photosensitive drums 1*a* to 1*d* via the intermediate transfer belt 8, a three-color apart state where only the primary transfer roller 6*d* is in pressed contact with the photosensitive drum 1*d* via the intermediate transfer belt 8, and a four-color apart state (all-color apart state) where the four primary transfer rollers 6*a* to 6*d* are all away from the intermediate transfer belt 8.

Figure 4:
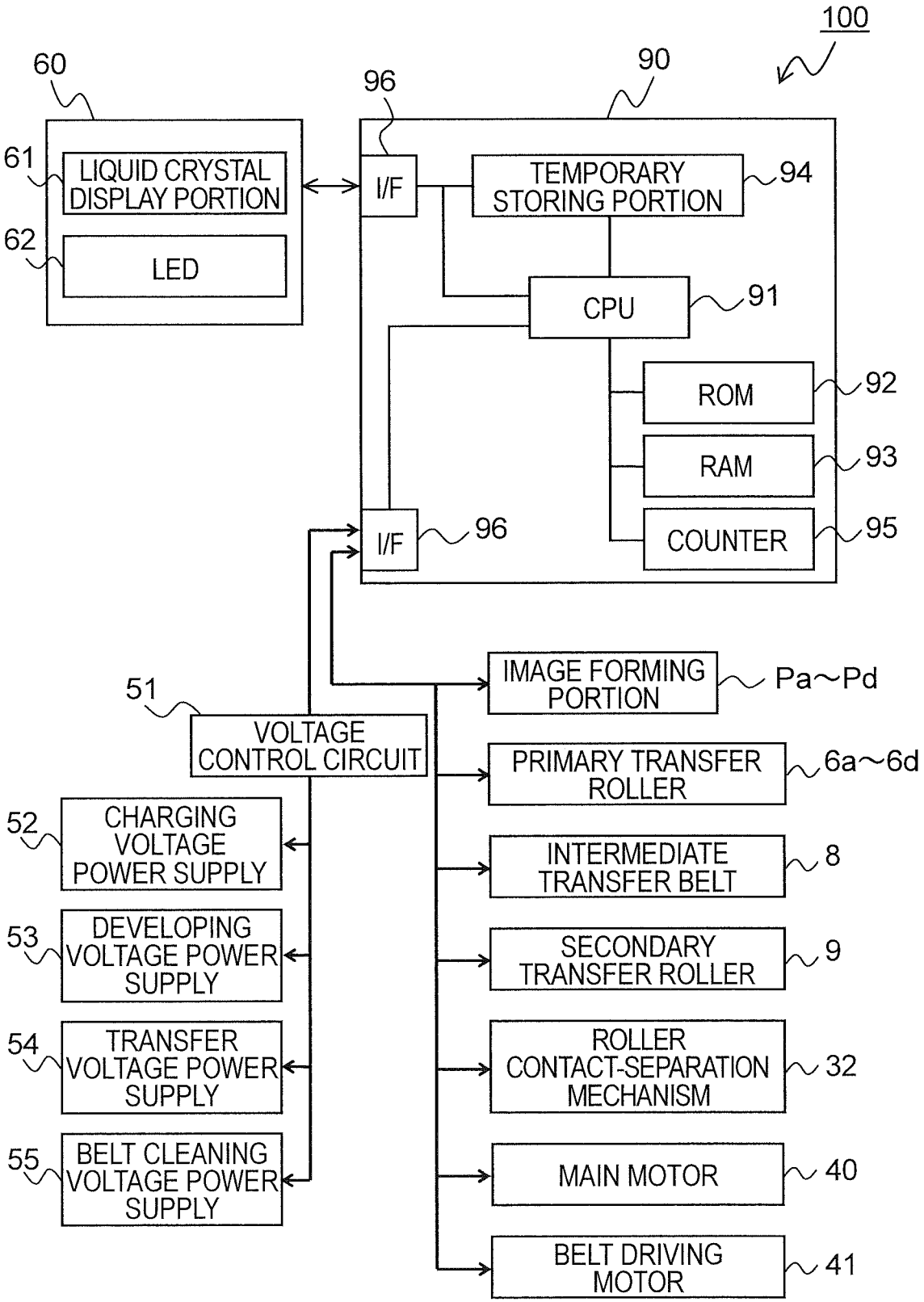
FIG. 4 is a block diagram showing control paths in the color printer.

FIG. 4 is a block diagram showing an example of control paths used in the color printer 100. During the use of the color printer 100, different blocks in it are controlled in various manners, and this complicates the control paths in the entire color printer 100. Thus, the following description focuses only on those controlling paths that are relevant to the embodiment of the present disclosure.

A control portion 90 includes at least a CPU (central processing unit) 91 which is a central processor device, a ROM (read-only memory) 92 which is a memory for reading only, a RAM (random-access memory) 93 which is for both reading and writing, a temporary storing portion 94 which temporarily stores image data and the like, a counter 95, and a plurality of (here, two) I/Fs (interfaces) 96 which transmit control signals to different blocks in the color printer 100 and which receive input signals from an operation portion 60. The control portion 90 can be arranged at any position in the main body of the device.

The ROM 92 stores data and the like which are not changed during the use of the color printer 100, such as a program for control of the color printer 100, values necessary for control, and the like. The RAM 93 stores necessary data generated in the process of controlling the color printer 100, data temporarily needed to control the color printer 100, and the like. The counter 95 counts the number of printed sheets on a cumulative basis. The RAM 93 (or the ROM 92) also stores the amount of toner ejected from the developing devices 3*a* to 3*d* in a reduced friction coefficient mode, which will be described later.

The control portion 90 transmits control signals from the CPU 91 via the I/Fs 96 to different blocks and devices in the color printer 100. From the different blocks and devices, signals showing their status and input signals are transmitted via the I/Fs 96 to the CPU 91. The different blocks and devices controlled by the control portion include, for example, the image forming portions Pa to Pd, the exposure unit 5, the primary transfer rollers 6*a* to 6*d*, the secondary transfer roller 9, the main motor 40, the belt driving motor 41, a voltage control circuit 51, and the operation portion 60.

The voltage control circuit 51 is connected to the charging voltage power supply 52, the developing voltage power supply 53, a transfer voltage power supply 54, and the belt cleaning voltage power supply 55, and operates those power supplies according to output signals from the control portion 90. Those power supplies operate according to control signals from the voltage control circuit 51 such that predetermined voltages are applied from the charging voltage power supply 52 to the charging rollers 21 in the charging devices 2*a* to 2*d*, from the developing voltage power supply 53 to the developing rollers 30 in the developing devices 3*a* to 3*d*, from the transfer voltage power supply 54 to the primary transfer rollers 6*a* to 6*d* and the secondary transfer roller 9, and from the belt cleaning voltage power supply 55 to the collection roller 25 of the belt cleaning unit 19.

The operation portion 60 is provided with a liquid crystal display portion 61 and LEDs 62 which indicate various statuses. A user operates a Stop/Clear button on the operation portion 60 to stop image formation, and operates a Reset button to bring the various settings of the color printer 100 back to the default settings. The liquid crystal display portion 61 indicates the status of the color printer 100, and displays the progress of image formation and the number of copies printed. Various settings for the color printer 100 are made via the printer driver on a personal computer.

When the color printer 100 is turned on (starts to be driven) for the second and following times, from the four-color pressure state where the photosensitive drums 1*a* to 1*d* are in contact with the intermediate transfer belt 8, the photosensitive drums 1*a* to 1*d* and the intermediate transfer belt 8 start to be driven. Thus, the driving state of the photosensitive drums 1*a* to 1*d* and the intermediate transfer belt 8 stabilizes quickly; this makes it possible to reduce the wait time before the first sheet is printed. However, when the color printer 100 starts to be driven from the four-color pressure state, from the perspective of prevention of slip marks (rubbing history) between the photosensitive drums 1*a* to 1*d* and the intermediate transfer belt 8 (hereinafter expressed as "drum-belt") and color misalignment, operation proceeds as shown in Table 1 below and in FIG. 5.

TABLE 1

| | AT START OF DRIVING | | | AT HALT OF DRIVING | | |
|---|---|---|---|---|---|---|
| | Δt (msec) | STEP | TOTAL t (msec) | Δt (msec) | STEP | TOTAL t (msec) |
| PHOTO-SENSITIVE DRUM | 14 | 8 | 112 | 20 | 8 | 160 |
| INTER-MEDIATE TRANSFER BELT | 14 | 6 | 84 | 20 | 6 | 120 |

Figure 5:
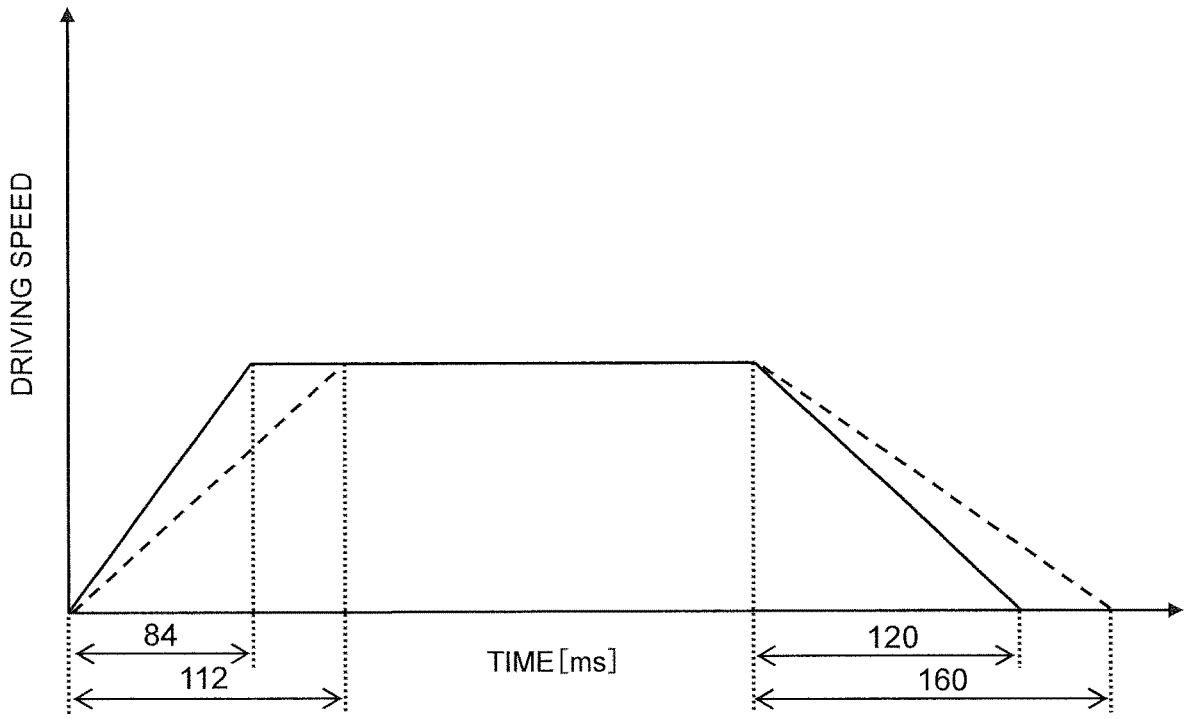
FIG. 5 is a graph showing an example of speed control at the start and halt of driving of a photosensitive drum and the intermediate transfer belt in the color printer according to this embodiment.

As shown in Table 1 and FIG. 5, at the start of driving, the photosensitive drums 1*a* to 1*d* (in FIG. 5, indicated by broken lines) and the intermediate transfer belt 8 (in FIG. 5, indicated by solid lines) are started up at the same time from the resting state. Thus, it is possible to minimize the drum-belt linear velocity difference, and thereby to prevent slip marks. Then, the linear velocity of the photosensitive drums 1*a* to 1*d* is increased every 14 msec to reach a predetermined speed in 8 steps. On the other hand, the linear velocity of the intermediate transfer belt 8 is increased every 14 msec to reach a predetermined speed in 6 steps.

That is, while the photosensitive drums 1*a* to 1*d* reach the predetermined speed in 14×8=112 msec, the intermediate transfer belt 8 reaches the predetermined speed in 14×6=84 msec. Thus, compared to the photosensitive drums 1*a* to 1*d*, the intermediate transfer belt 8 reaches the predetermined speed earlier, and this makes it possible to prevent color misalignment at the start of driving.

At the halt of driving, from a state where the photosensitive drums 1*a* to 1*d* and the intermediate transfer belt 8 are driven at the predetermined speed, they start to decelerate at the same time. Thus, as at the start of driving, it is possible to minimize the drum-belt linear velocity difference, and thereby to prevent slip marks. Then, the linear velocity of the photosensitive drums 1*a* to 1*d* is decreased every 20 msec to halt in 8 steps. On the other hand, the linear velocity of the intermediate transfer belt 8 is decreased every 20 msec to halt in 6 steps.

That is, while the photosensitive drums 1*a* to 1*d* halt in 20×8=160 msec, the intermediate transfer belt 8 halts in 20×6=160 msec from when they start to reduce their speed. Thus, compared to the photosensitive drums 1*a* to 1*d*, the intermediate transfer belt 8 halts earlier, and this makes it possible to prevent slip marks at the halt of driving.

However, when the color printer 100 is turned on (starts to be driven) for the first time, as described earlier, the intermediate transfer belt 8 having no toner external additive attached to it (not whitened yet) and thus having a high friction coefficient is combined with the unused photosensitive drums 1*a* to 1*d* having undergone preliminary charging and charging adjustment; thus, high adhesion between them produces a high drum-belt friction force. The friction results in lower charging performance, and lateral streaks appear in a half image at the positions (primary transfer positions) where the photosensitive drums 1*a* to 1*d* are in contact with the intermediate transfer belt 8 at the start of driving.

Though not so high as between drum and belt, a friction force is produced also between the photosensitive drums 1*a* to 1*d* and the cleaning blade 71 (hereinafter expressed as "drum-blade"), and thus lateral streaks slightly appear in a half image at the positions (blade positions) where the photosensitive drums 1*a* to 1*d* are in contact with the cleaning blade 71 at the start of driving.

Thus, in the color printer 100 according to this embodiment, at first power-on, the photosensitive drums 1*a* to 1*d* and the intermediate transfer belt 8 start to be driven in the four-color apart state. Then, while they continue being driven, a transition is made to the four-color pressure state. Then, the reduced friction coefficient mode is executed in which toner is ejected from the developing devices 3*a* to 3*d* to the photosensitive drums 1*a* to 1*d* so that toner is applied to the photosensitive drums 1*a* to 1*d* and the intermediate transfer belt 8, thereby to reduce the surface friction coefficient on the photosensitive drums 1*a* to 1*d* and the intermediate transfer belt 8.

Toner is ejected in the following manner. The surfaces of the photosensitive drums 1*a* to 1*d* are electrostatically charged uniformly by the charging devices 2*a* to 2*d*, and are then exposed, each in a belt-form area over the entire range in its longitudinal (axial) direction, light from the exposure unit 5 to form a toner ejection pattern. Then, a developing voltage is applied to the developing devices 3*a* to 3*d* to develop the toner ejection pattern.

The toner ejection pattern may be a solid image or a half image; where a large amount of toner needs to be ejected, it is preferable to use a solid image, to which a larger amount of toner attaches per unit area. The amount of toner ejected can be controlled by adjusting the dimension of the toner ejection pattern on the photosensitive drums 1*a* to 1*d* in the circumferential direction.

With respect to the friction between the photosensitive drums 1*a* to 1*d* and the cleaning blade 71, the amount of toner ejected is set to be sufficient to let toner attach uniformly over the entire range of an edge part of the cleaning blade 71 in its longitudinal direction and thereby reduce the drum-blade friction force, and also sufficient to give slipperiness to the photosensitive drums 1*a* to 1*d* with a toner external additive and thereby reduce the surface friction coefficient on the photosensitive drums 1*a* to 1*d*. With respect to the friction between the photosensitive drums 1*a* to 1*d* and the intermediate transfer belt 8, the amount of toner ejected is set to be sufficient to give slipperiness to, in addition to the photosensitive drums 1*a* to 1*d*, the intermediate transfer belt 8 with a toner external additive and thereby reduce the surface friction coefficient on the intermediate transfer belt 8.

There is no particular restriction on the timing with which toner is ejected so long as it takes place after a transition from the four-color apart state to the four-color pressure state; if, however, the linear velocity of the photosensitive drums 1*a* to 1*d* and the intermediate transfer belt 8 is increased to reach the predetermined speed (driving speed during image formation) without toner being ejected, slip marks and scratches may develop on the photosensitive drums 1*a* to 1*d*. To avoid that, it is preferable to reduce the driving speed of the photosensitive drums 1*a* to 1*d* and the intermediate transfer belt 8 during toner ejection compared with that during image formation.

When a transfer voltage (a voltage of the opposite polarity to toner) is applied to the primary transfer rollers 6*a* to 6*d*, the toner ejected from the developing devices 3*a* to 3*d* to the photosensitive drums 1*a* to 1*d* moves onto the intermediate transfer belt 8 at the primary transfer positions, and thus does not reach the blade position. As a remedy, a reverse-transfer voltage (a voltage of the same polarity as toner) is applied to the primary transfer rollers 6*a* to 6*d* until the ejected toner reaches the blade position and attaches to the edge part of the cleaning blade 71. In this way, the toner ejected to the photosensitive drums 1*a* to 1*d* reaches the blade position and attaches to the edge part of the cleaning blade 71 without moving to the intermediate transfer belt 8.

Then, the transfer voltage is applied to the primary transfer rollers 6*a* to 6*d*, and thus the toner on the photosensitive drums 1*a* to 1*d* moves to the intermediate transfer belt 8 and attaches to the surface of the intermediate transfer belt 8. By controlling the voltage applied to the primary transfer rollers 6*a* to 6*d* as described above, it is possible to effectively reduce both the surface friction coefficient on the photosensitive drums 1*a* to 1*d* and that on the intermediate transfer belt 8.

Moreover, not only at the first-time start of driving, but also when at least either the photosensitive drums 1*a* to 1*d* or the intermediate transfer belt 8 is replaced, the reduced friction coefficient mode is executed; it is thus possible to reduce the surface friction coefficient on the unused photosensitive drums 1*a* to 1*d* or the intermediate transfer belt 8. Here, when either the photosensitive drums 1*a* to 1*d* or the intermediate transfer belt 8 is replaced, toner can be ejected in such an amount as to reduce the surface friction coefficient on the replaced photosensitive drums 1*a* to 1*d* or intermediate transfer belt 8.

When only the photosensitive drums 1*a* to 1*d* are replaced, after toner is ejected, the reverse-transfer voltage is kept applied to the primary transfer rollers 6*a* to 6*d* until the reduced friction coefficient mode ends so that all the toner ejected to the photosensitive drums 1*a* to 1*d* can reach the blade position. When only part of the photosensitive drums 1*a* to 1*d* are replaced, toner can be ejected only to the replaced photosensitive drums 1*a* to 1*d*.

When only the intermediate transfer belt 8 is replaced, after toner is ejected, the transfer voltage is kept applied to the photosensitive drums 1*a* to 1*d* until the reduced friction coefficient mode ends so that all the toner ejected to the photosensitive drums 1*a* to 1*d* can move to the intermediate transfer belt 8. It is thereby possible to more effectively reduce the surface friction coefficient on the photosensitive drums 1*a* to 1*d* or the intermediate transfer belt 8.

Figure 6:
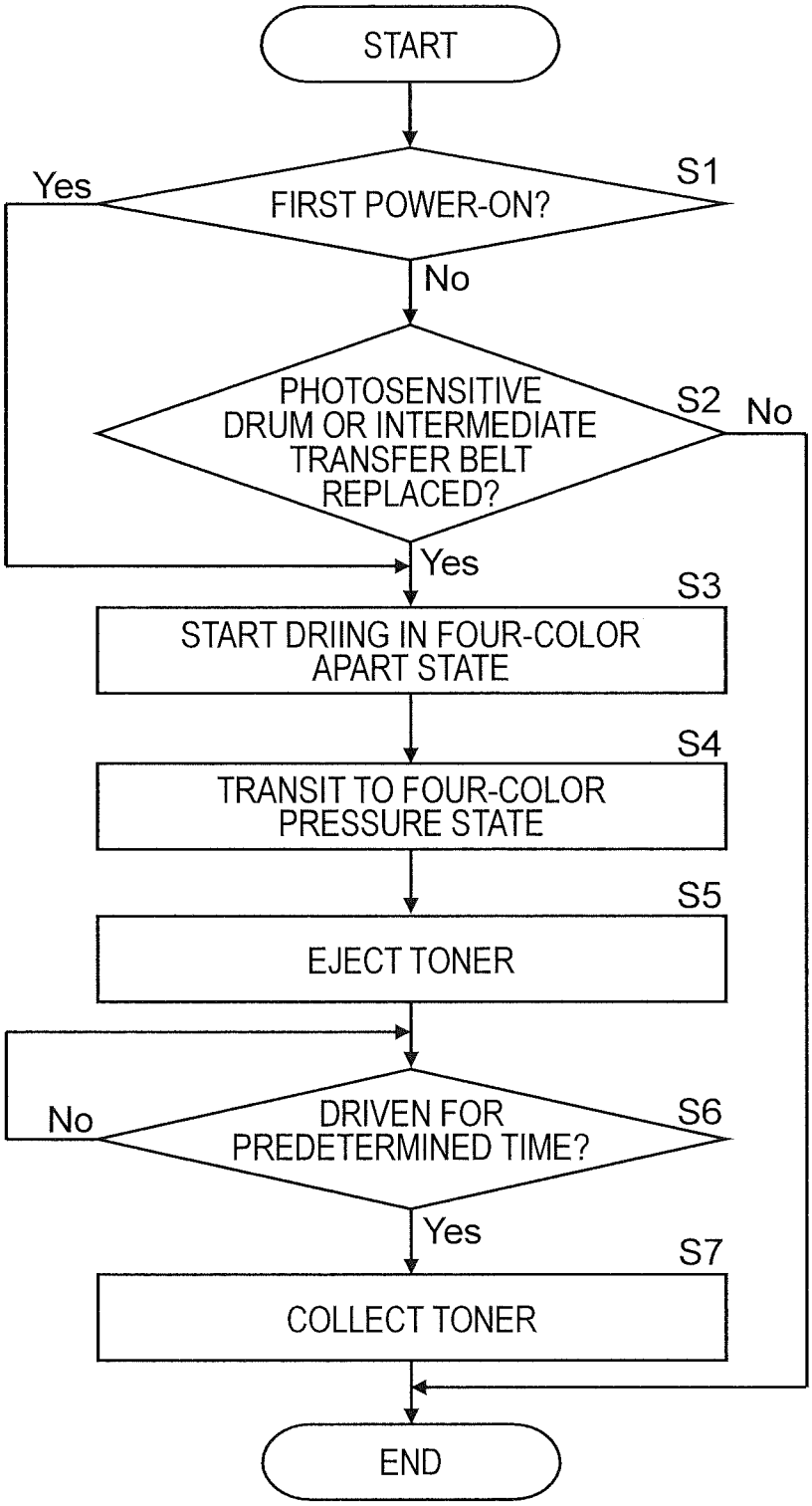
FIG. 6 is a flow chart showing an example of control in a reduced friction coefficient mode in the color printer according to this embodiment.

FIG. 6 is a flow chart showing an example of control in the reduced friction coefficient mode in the color printer 100 according to this embodiment. With reference to FIGS. 1 to 5 as necessary, a procedure for executing the reduced friction coefficient mode will be described along the steps in FIG. 6.

First, the control portion 90 checks whether or not the power to the color printer 100 is turned on for the first time (step S1). If it is not the first time that the power to the color printer 100 is turned on (step 1, No), then, next, the control portion 90 checks whether or not at least either the photosensitive drums 1*a* to 1*d* or the intermediate transfer belt 8 has been replaced (step S2). The check of whether or not the photosensitive drums 1*a* to 1*d* or the intermediate transfer belt 8 has been replaced is made, for example, by reading individual identification information that is recorded in an IC chip mounted on a drum unit (unillustrated) incorporating the photosensitive drums 1*a* to 1*d*, and also on the intermediate transfer unit 31, by use of a reader/writer module (unillustrated) provided in the main body of the color printer 100.

If it is the first time that the power to the color printer 100 is turned on (step S1, Yes), or if at least either the photosensitive drums 1*a* to 1*d* or the intermediate transfer belt 8 has been replaced (step S2, Yes), the control portion 90 executes the reduced friction coefficient mode. Specifically, the control portion 90 transmits a control signal to the main motor 40 and the belt driving motor 41, and starts to drive the photosensitive drums 1*a* to 1*d* and the intermediate transfer belt 8 in the four-color apart state where the primary transfer rollers 6*a* to 6*d* are away from the intermediate transfer belt 8 (step S3). Then, the control portion 90 transmits a control signal to the roller contact-separation mechanism 32 and puts the primary transfer rollers 6*a* to 6*d* into pressed contact with the photosensitive drums 1*a* to 1*d* via the intermediate transfer belt 8, thereby making, a transition from the four-color apart state to the four-color pressure state (step, S4).

Next, the surfaces of the photosensitive drums 1*a* to 1*d* are electrostatically charged and are exposed light to form the toner ejection pattern, and the developing devices 3*a* to 3*d* develop the toner ejection pattern; thus, toner is ejected to the photosensitive drums 1*a* to 1*d* (Step 5). Here, according to whether it is the first time that the power to the color printer 100 is turned on and whether the photosensitive drums 1*a* to 1*d* or the intermediate transfer belt 8 has been replaced, the amount of toner ejected and the polarity of the voltage applied to the primary transfer rollers 6*a* to 6*d* are changed. The toner ejected on the photosensitive drums 1*a* to 1*d*, when it reaches the cleaning blade 71, is collected by the cleaning devices 7*a* to 7*d*.

Then, it is checked whether or not the photosensitive drums 1*a* to 1*d* and the intermediate transfer belt 8 have been driven for a predetermined time (step S6). After they have been driven for the predetermined time, a cleaning voltage is applied from the belt cleaning voltage power supply 55 to the belt cleaning unit 19 so that the toner on the intermediate transfer belt 8 is collected (step S7), and the reduced friction coefficient mode ends.

Through the control in FIG. 6, at the first-time start of driving, when the photosensitive drums 1*a* to 1*d* or the intermediate transfer belt 8 is replaced, the reduced friction coefficient mode is executed; it is thus possible, prior to image forming operation, to reduce the surface friction coefficient on the photosensitive drums 1*a* to 1*d* and the intermediate transfer belt 8, and to attach toner to the edge part of the cleaning blade 71. As a result, in the following image forming operation, it is possible to effectively prevent lower charging performance resulting from the surfaces of the photosensitive drums 1*a* to 1*d* being rubbed hard, and to prevent the resulting appearance of lateral streaks in a half image. It is also possible to prevent the photosensitive layers of the photosensitive drums 1*a* to 1*d* from being scratched, and thereby to prolong their lifetime.

When the reduced friction coefficient mode is executed, the photosensitive drums 1*a* to 1*d* and the intermediate transfer belt 8 start to be driven in the four-color apart state, and then a transition is made to the four-color pressure state; it is thus possible to prevent lower charging performance on the photosensitive drums 1*a* to 1*d*, and scratching on the photosensitive drums 1*a* to 1*d*, resulting from rubbing between the photosensitive drums 1*a* to 1*d* and the intermediate transfer belt 8 in the reduced friction coefficient mode.

The present disclosure may be implemented in any other manner than in the embodiments described above, and allows for many modification without departure from the spirit of the present disclosure. For example, in the above-described embodiment, use is made of developing devices 3*a* to 3*d* of a two-component development type that feed toner to the photosensitive drums 1*a* to 1*d* by use of magnetic brushes formed on the developing rollers 30. Instead, use may be made of developing devices 3*a* to 3*d* of a type in which toner feeding rollers are arranged on the side of the developing rollers 30 opposite from the photosensitive drums 1*a* to 1*d* and only toner is moved from the toner feeding rollers to the developing rollers 30 by use of magnetic brushes formed on the toner feeding rollers to feed toner from the developing rollers 30 to the photosensitive drums 1*a* to 1*d*.

The present disclosure is not limited to a color printer 100 as shown in FIG. 1; it applies as well to color image forming apparatuses of any other intermediate transfer types, such as color copiers, color multifunction peripherals, and facsimile machines. Next, by way of practical examples, the effects of the present disclosure will be described more specifically.

Practical Examples

The effect of preventing lateral streaks in a half image as observed when the reduced friction coefficient mode is executed at the first-time start of driving was studied. As a test machine, a color multifunction peripheral (FS-C8525MFP, manufactured by Kyocera Document Solutions Inc.) was used. Under different conditions, namely one where the reduced friction coefficient mode was executed at the first-time start of driving (Practical Examples 1 to 3) and one where the reduced friction coefficient mode was not executed at the first-time start of driving (Comparative Examples 1 to 3), re-driving was performed from the four-color pressure state and a half image having a coverage rate 20% was printed; then, the incidence of lateral streaks was compared. Table 2 shows the results.

TABLE 2

| | PHOTO-SENSITIVE DRUM | INTER-MEDIATE TRANSFER BELT | OPERATION AT FIRST-TIME START OF DRIVING: AT START OF DRIVING | OPERATION AT FIRST-TIME START OF DRIVING: DURING STABLE DRIVING | AMOUNT OF TONER EJECTED: DRUM | AMOUNT OF TONER EJECTED: BELT | AMOUNT OF TONER CONSUMED | INCI-DENCE OF LATERAL STREAKS |
|---|---|---|---|---|---|---|---|---|
| PRACTICAL EXAMPLE 1 | NEW | NEW | FOUR-COLOR APART | FOUR-COLOR PRESSURE | 2 g | 4 g | 6 g | NO |
| PRACTICAL EXAMPLE 2 | OLD | NEW | FOUR-COLOR APART | FOUR-COLOR PRESSURE | — | 4 g | 4 g | NO |
| PRACTICAL EXAMPLE 3 | NEW | OLD | FOUR-COLOR APART | FOUR-COLOR PRESSURE | 2 g | — | 2 g | NO |
| COMPARATIVE EXAMPLE 1 | NEW | NEW | FOUR-COLOR APART | FOUR-COLOR PRESSURE | — | — | 0 g | 2 |
| COMPARATIVE EXAMPLE 2 | NEW | NEW | FOUR-COLOR APART | FOUR-COLOR PRESSURE | — | — | 0 g | 2 |
| COMPARATIVE EXAMPLE 3 | NEW | NEW | FOUR-COLOR APART | FOUR-COLOR PRESSURE | — | — | 6 g (*1) | 1 to 2 |

1*To eject 6 g of toner immediately prior to printing when re-driving is performed.

Table 1 reveals the following. In Practical Example 1, where new photosensitive drums 1*a* to 1*d* (unused ones having undergone preliminary charging and potential adjustment) and a new intermediate transfer belt 8 were used, driving was started in the four-color apart state to transit to the four-color pressure state, and the reduced friction coefficient mode was executed in which 6 g of toner (1.5 g per color, corresponding to three or more continuous turns of the belt) was ejected in a belt-form area in the longitudinal direction, no appearance of lateral streaks was observed when re-driving was performed from the four-color pressure state and a half image was printed.

Also in Practical Example 2, where the reduced friction coefficient mode was executed as in Practical Example 1 except that new intermediate transfer belt 8 was used and that the amount of toner ejected was set at 4 g (1 g per color), and in Practical Example 3, where the reduced friction coefficient mode was executed as in Practical Example 1 except that new photosensitive drums 1*a* to 1*d* were used and that the amount of toner ejected was set at 2 g (0.5 g per color), no appearance of lateral streaks was observed when re-driving was performed from the four-color pressure state and a half image was printed.

By contrast, in Comparative Example 1, where new photosensitive drums 1*a* to 1*d* and a new intermediate transfer belt 8 were used but driving was started in the four-color pressure state and toner was not ejected, and also in Comparative Example 2, where driving was started in the four-color apart state to transit to the four-color pressure state but toner was not ejected, two lateral streaks appeared at the primary transfer positions and at the blade positions when re-driving was performed from the four-color pressure state and a half image was printed. This indicates that, even if the first-time driving is started in the four-color apart state, if, when re-driving is performed, the four-color pressure state has been kept, lateral streaks appear resulting from lower charging performance.

Furthermore, in Comparative Example 3, where, in addition to the operation in Comparative Example 2, 6 g of toner was ejected immediately prior to printing when re-driving was performed, though the results were slightly better than in Comparative Examples 1 and 2, one to two lateral streaks appeared. This was because, in Comparative Example 3, slip marks that were remained on the photosensitive drums 1*a* to 1*d* were slightly relieved by toner ejection immediately prior to printing.

The above results confirm the following. At the first-time start of driving, and when either the photosensitive drums 1*a* to 1*d* or the intermediate transfer belt 8 is replaced, by executing the reduced friction coefficient mode and reducing the surface friction coefficient on the photosensitive drums 1*a* to 1*d* or the intermediate transfer belt 8, it is possible to prevent the appearance of lateral streaks in a half image resulting from the photosensitive drums 1*a* to 1*d* being rubbed.

The present disclosure finds application in image forming apparatuses of an intermediate transfer type that include an image carrying member and an intermediate transfer belt. Based on the present disclosure, it is possible to provide an image forming apparatus that reduces the friction force between the image carrying member and the intermediate transfer belt during initial use and that can prevent lateral streaks in a half image and scratches on the surface of the image carrying member.

What is claimed is:

1. An image forming apparatus comprising:

a plurality of image forming portions that include image carrying members and developing devices feeding toner to the image carrying members, the plurality of image forming portions forming images of different colors;

an intermediate transfer belt that is an endless belt, the intermediate transfer belt moving along the image forming portions, the intermediate transfer belt having an elastic layer;

a plurality of primary transfer members that are arranged opposite the image carrying members across the intermediate transfer belt, the plurality of primary transfer members primarily transferring toner images formed on the image carrying members to the intermediate transfer belt;

a contact-separation mechanism that moves the primary transfer members in a direction approaching the intermediate transfer belt to put the intermediate transfer belt into pressed contact with the image carrying members, the contact-separation mechanism moving the primary transfer members in a direction away from the intermediate transfer belt to move the intermediate transfer belt away from the image carrying members;

a secondary transfer member that makes contact with the intermediate transfer belt to secondarily transfer the toner images primarily transferred on the intermediate transfer belt to a recording medium;

a driving device that drives the image carrying members and the intermediate transfer belt to rotate individually;

a voltage applying device that applies a voltage to the primary transfer members and the secondary transfer member; and a control portion that controls the image forming portions, the contact-separation mechanism, the voltage applying device, and the driving device, wherein the contact-separation mechanism is switchable between an all-color pressure state where the primary transfer members are all in pressed contact with the image carrying members via the intermediate transfer belt, and an all-color apart state where the primary transfer members are all away from the intermediate transfer belt, and the control portion can execute, at first power-on, a reduced friction coefficient mode in which the control portion starts to drive the image carrying members and the intermediate transfer belt in the all-color apart state, then transits to the all-color pressure state, and then ejects toner from the developing device to the image carrying members to reduce a surface friction coefficient on the image carrying members and the intermediate transfer belt.

2. The image forming apparatus according to claim 1, wherein a driving speed of the image carrying members and the intermediate transfer belt during toner ejection to the image carrying members is lower than a driving speed of the image carrying members and the intermediate transfer belt during image formation.

3. The image forming apparatus according to claim 1, wherein the control portion applies, during toner ejection to the image carrying members, a reverse-transfer voltage which is a voltage of a same polarity as the toner to the primary transfer members from the voltage applying device, and applies, at a lapse of a given time, a transfer voltage which is a voltage of a opposite polarity to the toner to the primary transfer members from the voltage applying device.

4. The image forming apparatus according to claim 1, wherein the control portion executes the reduced friction coefficient mode when at least either the image carrying members or the intermediate transfer belt has been replaced.

5. The image forming apparatus according to claim 4, wherein the control portion reduces the amount of toner in executing the reduced friction coefficient mode when at least either the image carrying members or the intermediate transfer belt has been replaced compared with when the reduced friction coefficient mode is executed at a first-time start of driving.

6. The image forming apparatus according to claim 4, wherein in executing the reduced friction coefficient mode when only the image carrying members have been replaced, the control portion applies the reverse-transfer voltage which is a voltage of the same polarity as the toner to the primary transfer members when ejecting toner to the image carrying members and continues to apply the reverse-transfer voltage until the reduced friction coefficient mode ends.

7. The image forming apparatus according to claim 4, wherein the control portion ejects the toner only to the replaced image carrying members when the image carrying members have been replaced in part of the plurality of image forming portions.

8. The image forming apparatus according to claim 4, wherein in executing the reduced friction coefficient mode when only the intermediate transfer belt has been replaced, the control portion applies the transfer voltage which is a voltage of the opposite polarity to the toner to the primary transfer members when ejecting toner to the image carrying members and continues to apply the transfer voltage until the reduced friction coefficient mode ends.

9. The image forming apparatus according to claim 1, wherein the control portion starts, when starting image forming operation, to drive the image carrying members and the intermediate transfer belt simultaneously, and starts up the intermediate transfer belt to a predetermined speed earlier compared to the image carrying members, and starts, when halting image forming operation, to decelerate the image carrying members and the intermediate transfer belt simultaneously, and halts the intermediate transfer belt earlier compared to the image carrying members.

10. The image forming apparatus according to claim 1, further comprising:

a cleaning member that is arranged to make contact with surfaces of the image carrying members, the cleaning member cleaning the surfaces of the image carrying members.

11. The image forming apparatus according to claim 1, wherein the image carrying members are organic photosensitive members that have organic photosensitive layers formed of surfaces thereof.

* * * * *